US007999782B2

(12) United States Patent
Lin et al.

(10) Patent No.: US 7,999,782 B2
(45) Date of Patent: Aug. 16, 2011

(54) PANEL DISPLAY APPARATUS AND METHOD FOR DRIVING DISPLAY PANEL

(75) Inventors: Che-Li Lin, Taipei (TW); Chang-San Chen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 1018 days.

(21) Appl. No.: 11/161,762

(22) Filed: Aug. 16, 2005

(65) Prior Publication Data

US 2006/0284819 A1 Dec. 21, 2006

(30) Foreign Application Priority Data

Jun. 15, 2005 (TW) ..... 94119774 A

(51) Int. Cl.
*G09G 3/36* (2006.01)

(52) U.S. Cl. ..... 345/100

(58) Field of Classification Search ..... None
See application file for complete search history.

(56) References Cited

U.S. PATENT DOCUMENTS

| | | | | |
|---|---|---|---|---|
| 6,552,707 | B1 * | 4/2003 | Fujiyoshi | 345/98 |
| 6,583,777 | B2 * | 6/2003 | Hebiguchi et al. | 345/92 |
| 2002/0054003 | A1 * | 5/2002 | Kodate | 345/87 |
| 2003/0189559 | A1 * | 10/2003 | Lee et al. | 345/204 |
| 2005/0140638 | A1 * | 6/2005 | Lee et al. | 345/100 |

* cited by examiner

*Primary Examiner* — Tammy Pham
(74) *Attorney, Agent, or Firm* — Jianq Chyun IP Office

(57) ABSTRACT

A panel display apparatus and a method for driving the display panel are provided. The panel display apparatus includes a display panel and a plurality of source drivers. The display panel with X*Y display unit includes X+1 data lines, and each source driver has M+1 data output terminals $DO_{i,j}$. In addition, each of the data output terminals of the source drivers is electrically coupled to a corresponding data line of the display panel, respectively. The mentioned $DO_{i,j}$ represents the $j^{th}$ data output terminal of the $i^{th}$ source driver. Wherein, the data output terminal $DO_{i,M}$ and the data output terminal $DO_{i+1,0}$ are electrically coupled to a same data line of the display panel.

11 Claims, 5 Drawing Sheets

PANEL DISPLAY APPARATUS AND METHOD FOR DRIVING DISPLAY PANEL

CROSS-REFERENCE TO RELATED APPLICATION

This application claims the priority benefit of Taiwan application serial no. 94119774, filed on Jun. 5, 2005. All disclosure of the Taiwan application is incorporated herein by reference.

BACKGROUND OF THE INVENTION

1. Field of the Invention

The present invention relates to a display apparatus, and more particularly, to a panel display apparatus and a method for driving the display panel.

2. Description of the Related Art

The development of image display technology has been greatly improved during these years, and a great amount of the conventional CRT display apparatus has been replaced by the flat panel displays. A typical flat panel display includes TFT-LCD (Thin-Film Transistor Liquid Crystal Display), LTPS (Low Temperature Poly Silicon) LCD and OLED (Organic Light Emitting Diode). Recently, the LTPS LCD and a-Si TFT-LCD have become the mainstream of the flat panel display in the market. Different types of LCDs are commonly used in electronic apparatus such as a laptop computer (a.k.a. notebook computer), a monitor, an AV device, a TV and a mobile phone (a.k.a. cellular phone).

Figure 1:
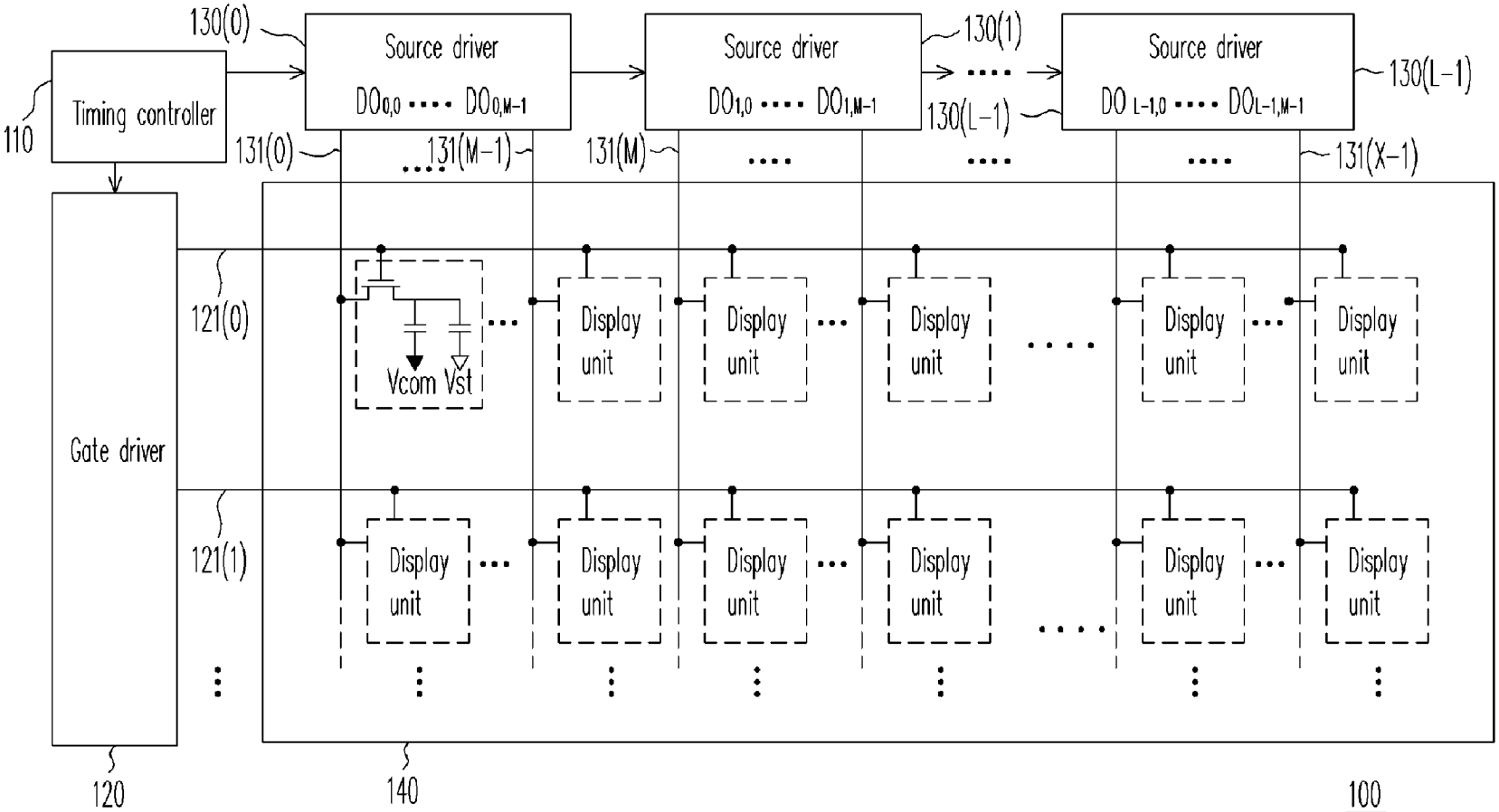
FIG. 1 (PRIOR ART)

The LCD display apparatus is exemplified hereinafter for description. FIG. 1 schematically shows a block diagram of a conventional LCD display apparatus. Referring to FIG. 1, the display panel 140 of the panel display apparatus 100 comprises a display unit array. Wherein, the display unit array is an m×n matrix, and each display unit is controlled by the source driver 130 and the gate driver 120 via the data line 131 and the scan line 121, respectively. Each of the source drivers 130 is composed of source drivers 130(0)~130(L−1). In addition, each display unit has its respective switch (e.g. TFT), liquid crystal capacitor and storage capacitor. Wherein, the switch transmits the data of the corresponding data line to the liquid crystal capacitor and the storage capacitor in response to the signal of the scan line. The liquid crystal capacitor and the storage capacitor store the data of the data line in response to the common voltage Vcom and the storage voltage Vst, respectively. The source driver 130 drives the corresponding display unit based on the rasterized pixel data provided by a timing controller 110. With the control from the gate driver 120 and the source driver 130, each display unit displays a desired color at a desired time point.

However, along with the trend of large-size panel and the increase of resolution as well as the fact that higher voltage is required to drive the wide view angle technique such as In-plane Switching (IPS) or Multi-domain Vertically Alignment (MVA), the power consumption on the conventional panel display apparatus has been greatly increased. In the consideration of environmental protection, how to reduce the power consumption of the panel display apparatus has become an important subject.

Figure 2:
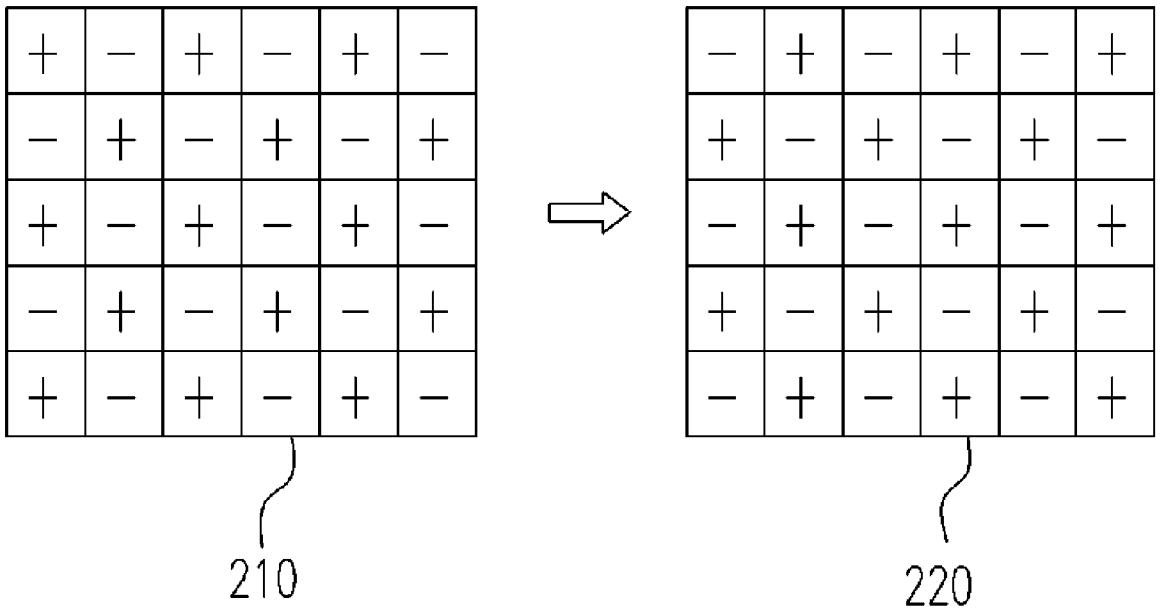
FIG. 2 (PRIOR ART)

In addition, since the liquid crystal is used by the display panel of the TFT-LCD to control the display, in order to avoid the liquid crystal from polarization, the liquid crystal should be driven in an alternating current way. Accordingly, various polarity inversion driving methods such as Line Inversion, Dot Inversion and Column Inversion driving methods have been developed. FIG. 2 schematically shows a diagram illustrating a conventional dot inversion method for driving the display panel. As shown in the diagram, in the $n^{th}$ frame 210, the polarity of the adjacent display units is opposite with each other. When the $(N+1)^{th}$ frame 220 is displayed on the display panel 100, the polarity of each display unit is inversed.

Figure 3:
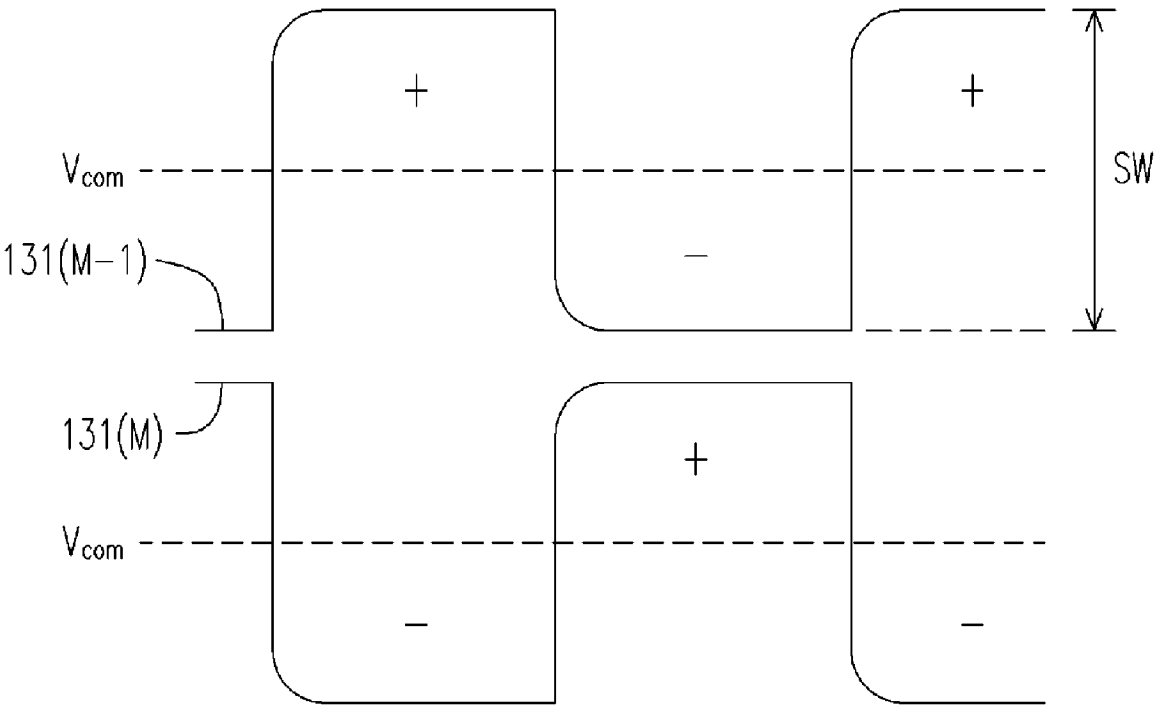
FIG. 3 (PRIOR ART)

FIG. 3 schematically shows a signal timing diagram illustrating the odd data lines and the even data lines (i.e. the data lines 131(M−1) and 131(M)) of FIG. 1. Since the large-size panel is typically designed to use the DC common voltage Vcom, the data line 131 of the display panel 140 has a positive voltage (represented by "+") higher than the common voltage Vcom and a negative voltage (represented by "−") lower than the common voltage Vcom. Accordingly, the source driver has to provide a swing voltage SW whose value is about two times of the common voltage Vcom. The scale of the swing voltage SW will influence the amount of the power consumed.

SUMMARY OF THE INVENTION

Therefore, it is an object of the present invention to provide a panel display apparatus and a method for driving the display panel. With the present invention, most of time a single polarity is maintained on the data line of the display panel, such that the swing voltage on the data line is reduced, and the power consumption of the display panel is further reduced for achieving the object of saving power.

In order to achieve the object mentioned above and others, the present invention provides a panel display apparatus comprising a display panel and L source drivers (where L is a positive integer). The display panel has X+1 data lines (where X is a positive integer) for displaying image in response to the signal of each data line. In addition, each source driver has M+1 data output terminals $DO_{i,j}$ (where M is a positive integer). Wherein, each of the data output terminals of the source drivers is electrically coupled to a corresponding data line of the display panel, respectively. The mentioned $DO_{i,j}$ represents the $j^{th}$ data output terminal of the $i^{th}$ source driver; where i is an integer greater than or equal to 0 but less than L, and j is an integer greater than or equal to 0 but less than or equal to M. Furthermore, the data output terminal $DO_{i,M}$ and the data output terminal $DO_{i+1,0}$ are electrically coupled to the same data line of the display panel.

In another aspect of the present invention, the present invention further provides a display panel driving method for driving a display panel having X+1 data lines. The display panel is electrically coupled to L source drivers, each having M+1 data output terminals $DO_{i,j}$. Wherein, each of the data output terminals of the source drivers is electrically coupled to a corresponding data line of the display panel, respectively. The described $DO_{i,j}$ represents the $j^{th}$ data output terminal of the $i^{th}$ source driver; where i is an integer greater than or equal to 0 but less than L, j is an integer greater than or equal to 0 but less than or equal to M. L, M, and X are all positive integers. Furthermore, the data output terminal $DO_{i,M}$ and the data output terminal $DO_{i+1,0}$ are electrically coupled to the same corresponding data line of the display panel. The method for driving the display panel comprises the following steps. First, when the nth scan line (where n is a positive integer) among a plurality of the scan lines of the display panel is being scanned, the $M^{th}$ data output terminal $DO_{i,M}$ of each source driver is disabled, such that each source driver transmits a signal to the corresponding data line of the display panel via the data output terminals $DO_{i,0}$ to $DO_{i,M-1}$. When the $(n+1)^{th}$ scan line among the plurality of the scan lines of the display panel is being scanned, the $0^{th}$ data output terminal $DO_{i,0}$ of each source driver is disabled, such that each source driver transmits a signal to a corresponding data line of the display panel via the data output terminals $DO_{i,1}$ to $DO_{i,M}$.

In two adjacent source drivers of the present invention, both of the last data output terminal $DO_{i,M}$ of the previous source driver and the first data output terminal $DO_{i+1},\mathbf{0}$ of the next source driver are jointly coupled to the same corresponding data line, and the signal is output in turn from the data output terminal $DO_{i,M}$ and the data output terminal $DO_{i+1},\mathbf{0}$ based on a timing of scanning the display panel. Accordingly, most of time a single corresponding polarity is maintained on each data line of the display panel, such that the swing voltage on each data line is reduced, and the power consumption of the display panel is further reduced for achieving the object of saving power.

BRIEF DESCRIPTION DRAWINGS

The accompanying drawings are included to provide a further understanding of the invention, and are incorporated in and constitute a part of this specification. The drawings illustrate embodiments of the invention, and together with the description, serve to explain the principles of the invention.

FIG. 1 schematically shows a block diagram of a conventional LCD apparatus.

FIG. 2 schematically shows a diagram illustrating a conventional dot inversion method for driving the display panel.

FIG. 3 schematically shows a signal timing diagram of the data lines in FIG. 1.

Figure 4:
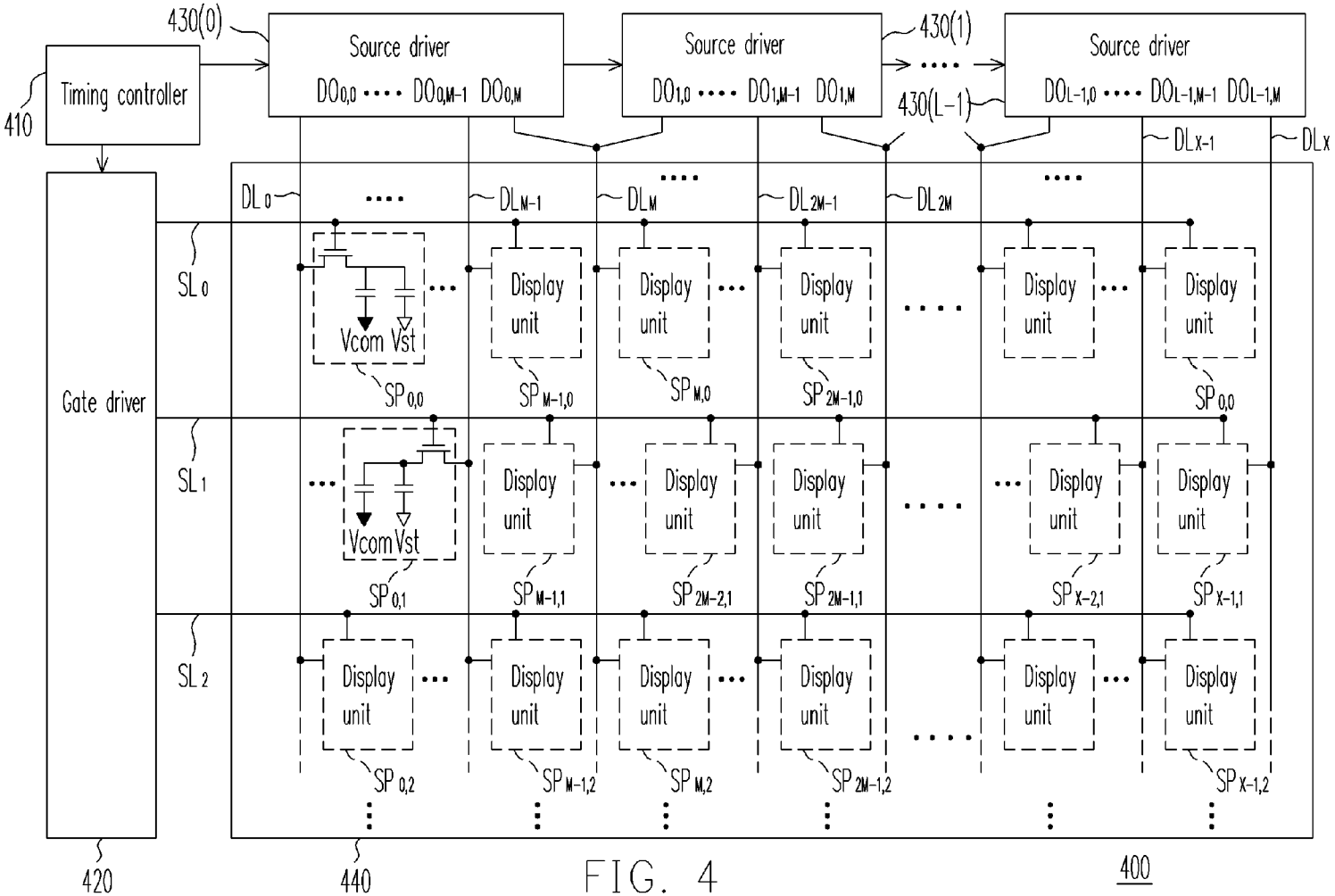

FIG. 4 schematically shows a panel display apparatus according to a preferred embodiment of the present invention.

Figure 5:
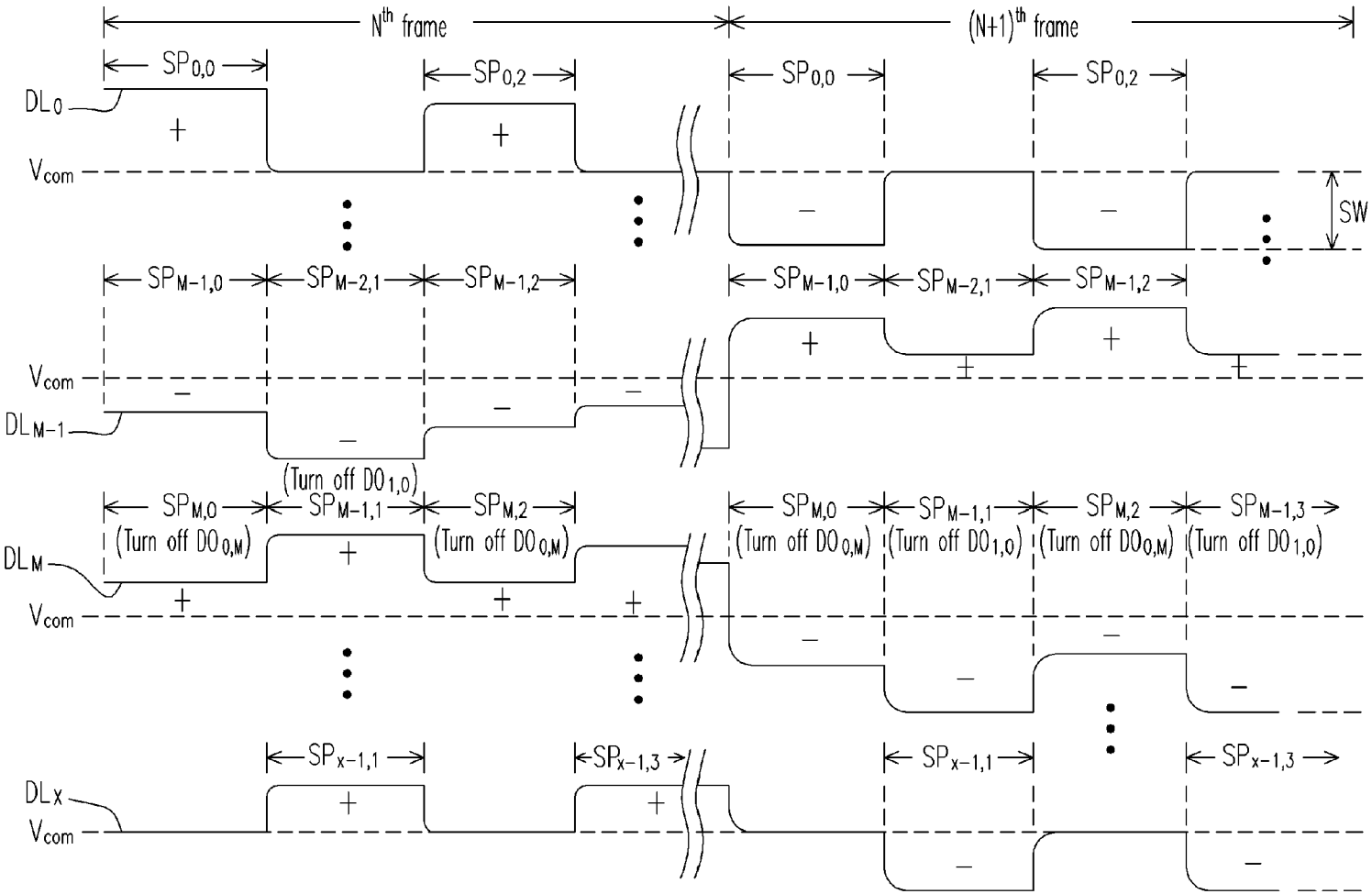

FIG. 5 schematically shows a signal timing diagram of the data lines in FIG. 4.

DESCRIPTION PREFERRED EMBODIMENTS

The LCD display panel display is exemplified hereinafter for describing the present invention in greater detail. However, other types of display panels should be easily inferred by one of the ordinary skill in the art based on the spirit of the present invention and the description of the following embodiments. FIG. 4 schematically shows a panel display apparatus according to a preferred embodiment of the present invention. Referring to FIG. 4, the panel display apparatus 400 comprises a timing controller 410, a gate driver 420, a source driver 430 and an LCD display panel 440. In the real implementation, the gate driver 420 and the source driver 430 are commonly formed by one or more serially connected integrated circuits (ICs). For example, as shown in FIG. 4, the source driver 430 comprises L source drivers 430(0) to 430 (L−1), where L is a positive integer. It is assumed that the display panel 440 has X+1 data lines $DL_0$~$DL_X$, Y scan lines $SL_0$~$SL_{Y-1}$, and X*Y display units $SP_{0,0}$~$SP_{X-1,Y-1}$, where X and Y are positive integers. $DL_i$ represents the $i^{th}$ data line, $SL_j$ represents the $j^{th}$ scan line, $SP_{n,j}$ represents the display unit of the nth column and the $j^{th}$ row, where i is an integer greater than or equal to 0 but less than X+1, j is an integer greater than or equal to 0 but less than Y, and n is an integer greater than or equal to 0 but less than X. Wherein, the display unit $SP_{n,2t}$ is electrically coupled to the scan line $SL_{2t}$ and the data line $DL_n$, and the display unit $SP_{n,2t+1}$ is electrically coupled to the scan line $SL_{2t+1}$ and the data line $DL_{n+1}$, where t is an integer greater than or equal to 0 but less than Y/2.

Each of the source drivers 430 has M+1 data output terminals $DO_{i,j}$, respectively. $DO_{i,j}$ represents the $j^{th}$ data output terminal of the $i^{th}$ source driver, where i is an integer greater than or equal to 0 but less than L, j is an integer greater than or equal to 0 but less than or equal to M, and M is a positive integer. In addition, each data output terminal $DO_{0,0}$~$DO_{L-1,M}$ of the source driver 430 is electrically coupled to a corresponding data line of the display panel, respectively. Wherein, the data output terminal $DO_{i,M}$ and the data output terminal $DO_{i+1,0}$ are electrically coupled to the same corresponding data line of the display panel 440. For example, both of the last data output terminal $DO_{0,M}$ of the source driver 430(0) and the first data output terminal $DO_{1,0}$ of the source driver 430(1) are jointly coupled to the same corresponding data line $DL_M$ of the display panel 440.

Here, the display units $SP_{0,0}$~$SP_{X-1,Y-1}$ may be any display unit designed by the conventional techniques, hence, its detailed circuit design is not described herein. Each display unit transmits the data of the electrically coupled data line to its internal liquid crystal capacitor and the storage capacitor based on a control timing provided by the electrically coupled scan line $SL_0$. In addition, the liquid crystal capacitor and the storage capacitor inside each display unit store the data of the data line in response to the common voltage Vcom and the storage voltage Vst, respectively.

The gate driver 420 turns on the display unit of the corresponding row via the scanning lines $SL_0$~$SL_{Y-1}$ in a manner of line by line. In response to a timing of the gate driver 420, the source drivers 430(0)~430(L−1) transmit the display data to the corresponding display unit via the data lines $DL_0$~$DL_X$. FIG. 5 schematically shows a signal timing diagram of the data lines $DL_0$~$DL_X$ in FIG. 4. Referring to FIG. 4 and FIG. 5, although it is assumed herein that M is an even number, other number can be easily inferred by the one of the ordinary skill in the art based on the description of the present embodiment. In the present embodiment, the display units on the same location of the odd row and even row (e.g. the display units $SP_{M-1,0}$ and $SP_{M-1,1}$) inside the display panel 440 are electrically coupled to different data lines, respectively. As such, most of time the data lines $DL_0$~$DL_X$ on the display panel 440 maintain a single polarity, respectively. Accordingly, the swing voltage SW of the data line on the display panel is reduced when the image is being scanned (it is reduced to 50% compared to the conventional technique), such that the power consumption of the panel display is further reduced for achieving the object of saving power.

When the $n^{th}$ scanning line among a plurality of the scan lines of the display panel 440 is being scanned, the last data output terminal $DO_{i,M}$ of each source driver 430 is disabled (or turned off), such that each source driver 430 transmits a signal to a corresponding data line of the display panel 440 via the data output terminals $DO_{i,0}$ to $DO_{i,M-1}$. When the $(n+1)^{th}$ scan line among the plurality of the scan lines of the display panel 440 is being scanned, the $0^{th}$ data output terminal $DO_{i,0}$ of each source driver 430 is disabled (or turned off), such that each source driver 430 transmits a signal to a corresponding data line of the display panel 440 via the data output terminals $DO_{i,1}$ to $DO_{i,M}$. For example, when the gate driver 420 is scanning the scan line $SL_0$, the data output terminal $DO_{0,M}$ of the source driver 430(0) is disabled (or turned off), such that the data output terminals $DO_{i,0}$ of the source driver 430(1) transmits a signal to the display unit $SP_{M,0}$ via the data line $DL_M$. When the gate driver 420 is scanning the scan line $SL_1$, the data output terminal $DO_{1,0}$ of the source driver 430(1) is disabled (or turned off), such that the data output terminals $DO_{0,M}$ of the source driver 430(0) transmits a signal to the display unit $SP_{M-1,1}$ via the data line $DL_M$. When the gate driver 420 is scanning the scan line $SL_2$, the data output terminal $DO_{0,M}$ of the source driver 430(0) is disabled (or turned off) again, such that the data output terminals $DO_{i,0}$ of the source driver 430(1) transmits a signal to the display unit $SP_{M,2}$ via the data line $DL_M$. The rest can be deduced by applying the same.

In the present embodiment, it is assumed that after a full frame data has been transmitted by each respective data line, the polarity of the even data line $DL_{2S}$ (e.g. $DL_0$) and the polarity of the odd data line $DL_{2S+1}$ (e.g. $DL_1$) is inversed. Accordingly, the data lines $DL_0$~$DL_X$ on the display panel 440 can maintain a single polarity during the period of the same frame, respectively, such that the dot inversion driving effect as shown in FIG. 2 is achieved. However, the polarity of each data line can be inversed at an appropriate time point determined by the one of the ordinary skill in the art based on the physical requirement. For example, the polarity of the even data line $DL_{2S}$ (e.g. $DL_0$) and the polarity of the odd data line $DL_{2S+1}$ (e.g. $DL_1$) may be exchanged after an accumulated time amount is equal to a randomly determined time.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A panel display apparatus, comprising:

a display panel having X+1 data lines and a plurality of display units, the display units display an image in response to signals, where X is a positive integer; and L source drivers each having M+1 data output terminals $DO_{i,j}$, wherein, each data output terminal of the source drivers is directly electrically coupled to a corresponding data line of the display panel respectively, where $DO_{i,j}$ represents the $j^{th}$ data output terminal of the $i^{th}$ source driver, i is an integer greater than or equal to 0 but less than L, j is an integer greater than or equal to 0 but less than or equal to M, and L and M are positive integers;

wherein, the $M^{th}$ data output terminal $DO_{i,M}$ of the M+1 data output terminals of the $i^{th}$ source driver of the L source drivers and the $0^{th}$ data output terminal $DO_{i+1,0}$ of the M+1 data output terminals of the $(i+1)^{th}$ source driver of the L source drivers are directly electrically coupled to a same corresponding data line of the display panel, and the X+1 data lines are directly electrically coupled between the M+1 data output terminals $DO_{i,j}$ and the display units, and the signals are transmitted from the data output terminals through the data lines to the display units.

2. The panel display apparatus of claim 1, wherein the signals are output in turn from the data output terminal $DO_{i,M}$ and the data output terminal $DO_{i+1,0}$ based on a timing of scanning a plurality of scan lines of the display panel.

3. The panel display apparatus of claim 1, wherein M*L is greater than or equal to X.

4. The panel display apparatus of claim 1, wherein the display panel is an LCD display panel.

5. The panel display apparatus of claim 1, wherein the polarities of the signals in two adjacent data lines on the display panel are opposite.

6. A display panel driving method for driving a display panel having X+1 data lines and a plurality of display units, wherein the display units display an image in response to signals, the display panel is electrically coupled to L source drivers, each having M+1 data output terminals $DO_{i,j}$, and each data output terminal of the source drivers is directly electrically coupled to a corresponding data line of the display panel respectively, where $DO_{i,j}$ represents the $j^{th}$ data output terminal of the $i^{th}$ source driver, i is an integer greater than or equal to 0 but less than L, j is an integer greater than or equal to 0 but less than or equal to M, and L, M and X are all positive integers, additionally, the $M^{th}$ data output terminal $DO_{i,M}$ of the M+1 data output terminals of the $i^{th}$ source driver of the L source drivers and the $0^{th}$ data output terminal $DO_{i+1,0}$ of the M+1 data output terminals of the $(i+1)^{th}$ source driver of the L source drivers are directly electrically coupled to a same corresponding data line of the display panel, the X+1 data lines are directly electrically coupled between the M+1 data output terminals $DO_{i,j}$ and the display units, the signals are transmitted from the data output terminals through the data lines to the display units, and the driving method comprises:

when the $n^{th}$ scan line among a plurality of scan lines of the display panel is being scanned, disabling the $M^{th}$ data output terminal $DO_{i,M}$ of each of the source drivers, such that each of the source drivers transmits signal to a corresponding data line of the display panel via the data output terminals $DO_{i,0}$ to $DO_{i,M-1}$ where n is a positive integer; and when the $(n+1)^{th}$ scan line among the plurality of scan lines of the display panel is being scanned, disabling the $0^{th}$ data output terminal $DO_{i,0}$ of each of the source drivers, such that each of the source drivers transmits signal to the corresponding data line of the display panel via the data output terminals $DO_{i,1}$ to $DO_{i,M}$.

7. The method for driving the display panel of claim 6, wherein the polarities of the signals in two adjacent data lines on the display panel are opposite.

8. The method for driving the display panel of claim 6, wherein M*L is greater than or equal to X.

9. The method for driving the display panel of claim 6, wherein the display panel is an LCD display panel.

10. The panel display apparatus of claim 1, wherein the display units are arranged in an X*Y array, where Y is a positive integer.

11. The method for driving the display panel of claim 6, wherein the display units are arranged in an X*Y array, where Y is a positive integer.

* * * * *